US009093058B1

(12) United States Patent
Harris

(10) Patent No.: US 9,093,058 B1
(45) Date of Patent: Jul. 28, 2015

(54) GUITAR PICKUP AND SYSTEM FOR TESTING THE SAME

(71) Applicant: Jeffrey M. Harris, Lake Forest, CA (US)

(72) Inventor: Jeffrey M. Harris, Lake Forest, CA (US)

( * ) Notice: Subject to any disclaimer, the term of this patent is extended or adjusted under 35 U.S.C. 154(b) by 8 days.

(21) Appl. No.: 14/229,100

(22) Filed: Mar. 28, 2014

(51) Int. Cl.
*G10H 3/14* (2006.01)

(52) U.S. Cl.
CPC ..... *G10H 3/14* (2013.01)

(58) Field of Classification Search
CPC ..... G10H 3/14
See application file for complete search history.

(56) References Cited

U.S. PATENT DOCUMENTS 8,269,095 B1 * 9/2012 Wallace ..... 84/726

OTHER PUBLICATIONS

Show Your Pickup Tester Guitars/Jigs | The GearPage.net, posted Oct. 26, 2013 viewed May 22, 2015 http://www.thegearpage.net/board/index.php?threads/show-your-pickup-tester-guitars-jigs.1339635/.*

Pickup testing guitar, posted Sep. 7, 2009, viewed May 29, 2015 at http://music-electronics-forum.com/t15009/.*

* cited by examiner

*Primary Examiner* — Robert W Horn

(57) ABSTRACT

A system is configured to test a pickup on a guitar without soldering the pickup to the guitar. The system includes an inverted pickup mechanically coupled to pickup wires. A testing system is connected to the inverted pickup and includes a base plate configured to accommodate the inverted pickup proximate strings on the guitar. Two leveling rods are configured to be threaded through the base plate and inserted through a pickup mounting plate while being immediately adjacent to the guitar on one end. A circuit board is attached to the base plate and configured to be electrically coupled to the pickup wires. The circuit board further comprises a phone jack which is configured to be electrically coupled to an amplifier. The amplifier emits sound which can be used to test the inverted pickup.

6 Claims, 4 Drawing Sheets

GUITAR PICKUP AND SYSTEM FOR TESTING THE SAME

BACKGROUND

The embodiments herein relate generally to musical instruments. In particular embodiments relate to diagnostic equipment for an electric guitar.

Prior to embodiments of the disclosed invention, for a guitarist or guitar repair technician to sample a different guitar pickup on a guitar, one had to remove the existing guitar strings, remove all pickup and pick guard hardware, unsolder the existing pickup from internal electronics, and then remove all pickup mounting hardware. Then, to install and sample the new guitar pickup, one would need to re-attach all pickup mounting hardware, re-solder the new pickup to internal electronics, attach all pickup and pick guard hardware, re-attach guitar strings and retune. This was extremely tedious and ran the risk of damaging the fragile wiring inside the guitar while greatly reducing the life of the strings. Most guitarists had not attempted to do this because of the delicate nature of the internal electronics and the fact that it was extremely time consuming. Guitar repair technicians charged a decent amount of money to do this type of repair or modification because it requires a good degree of skill to do it right, and there was always the risk of damaging the guitar and its internal electronics. Embodiments of the disclosed invention solve these problems.

SUMMARY

A system is configured to test a pickup on a guitar having guitar strings. The system comprises an inverted pickup that is mechanically coupled to pickup wires. A testing system is connected to the inverted pickup.

The testing system further comprises: a base plate having a central section configured to accommodate the inverted pickup. The inverted pickup is proximate the guitar strings. A first leveling rod is configured to be threaded through the base plate and inserted through a pickup mounting plate. The first leveling rod is further configured to be immediately adjacent to the guitar. A second leveling rod is configured to be threaded through the base plate and inserted through the pickup mounting plate. The second leveling rod is further configured to be immediately adjacent to the guitar. The pickup mounting plate is immediately adjacent to the inverted pickup.

A circuit board is mechanically coupled to the base plate and configured to be electrically coupled to the pickup wires. The circuit board further comprises a phone jack which is configured to be electrically coupled to an amplifier. The amplifier emits sound which can be used to test the inverted pickup.

In some embodiments, the circuit board can further comprise a terminal block configured to receive the pickup wires. In some embodiments, the circuit board can further comprise a slide switch to implement various wiring configurations of the pickup under test. In some embodiments, the circuit board is mechanically coupled to the base plate with stand-offs which slightly raise the circuit board from the base plate to facilitate cooling the base plate.

In some embodiments, the first leveling rod can be further configured to be immediately adjacent to the guitar with a first suction cup. The second leveling rod can be further configured to be immediately adjacent to the guitar with a second suction cup.

In some embodiments, a foam rubber strip can be mechanically coupled to the pickup mounting plate. The foam rubber strip further secures the inverted pickup to the base plate.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
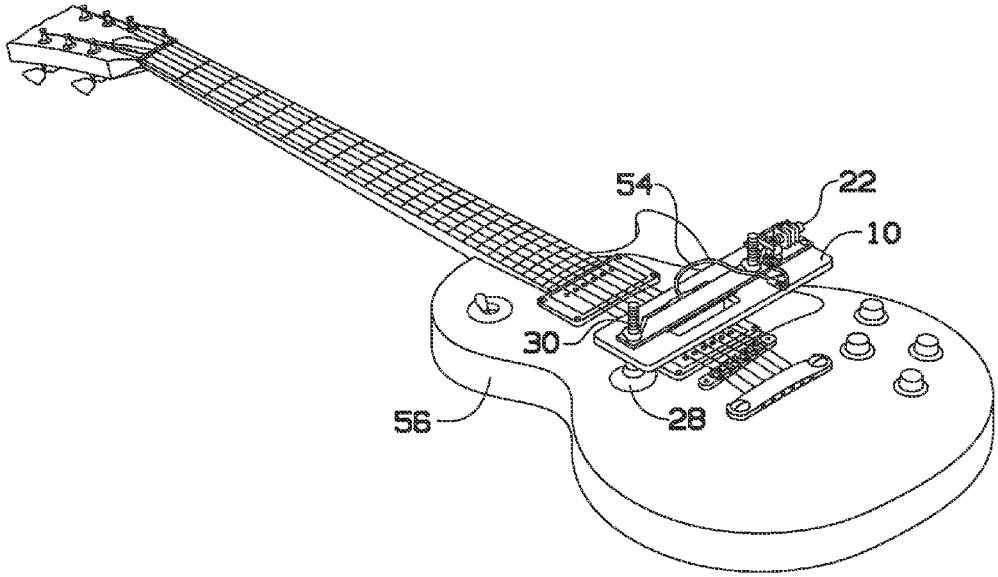
FIG. 1 is a perspective view of an embodiment of the invention, shown in use
Figure 2:
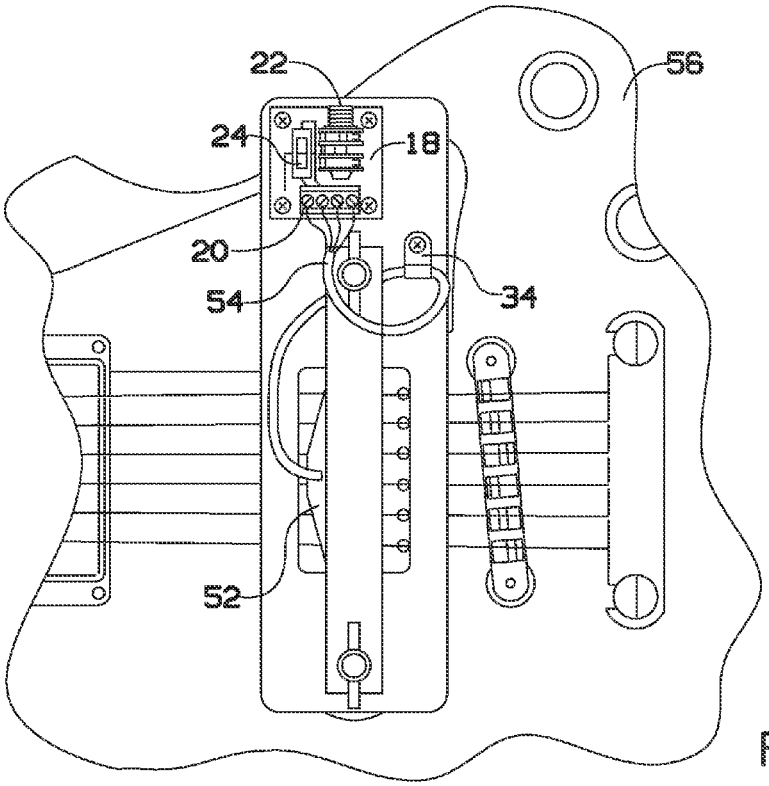
FIG. 2 is a detail top view of an embodiment of the invention, shown in use

By way of example, and referring to FIG. 1 and FIG. 2, guitar 56 has strings. A user can insert a testing system over the strings. The testing system includes base plate 10 is attached to leveling rods 30 wherein each leveling rod is attached to a suction cup 28. Suction cup 28 attaches base plate 10 to guitar 56.

Figure 3:
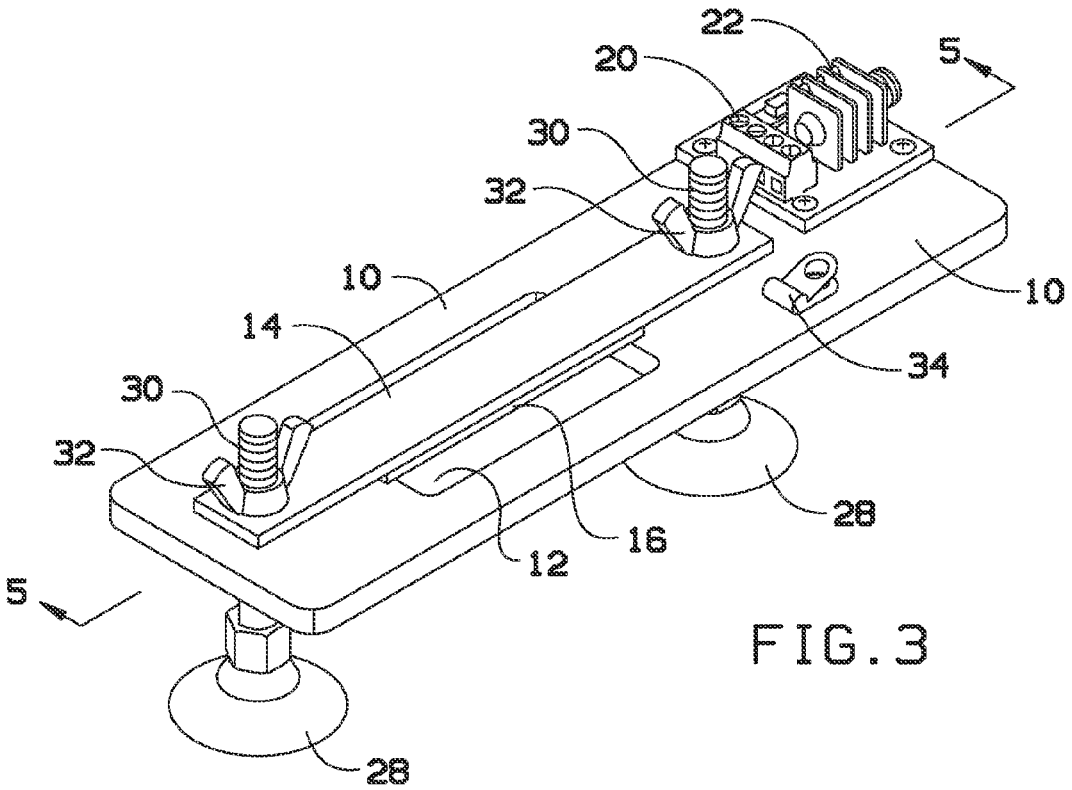
FIG. 3 is a perspective view of an embodiment of the invention
Figure 4:
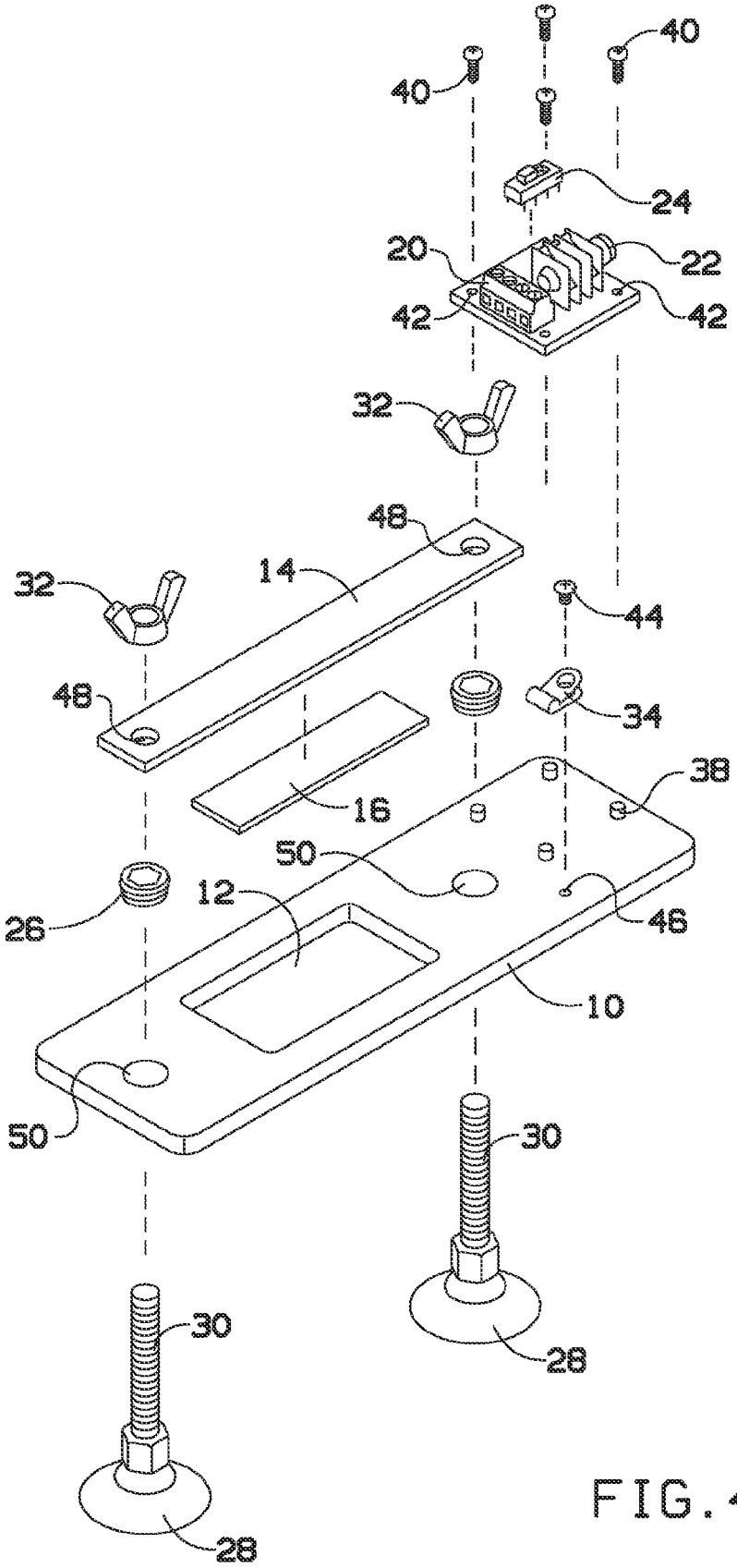
FIG. 4 is an exploded view of an embodiment of the invention
Figure 5:
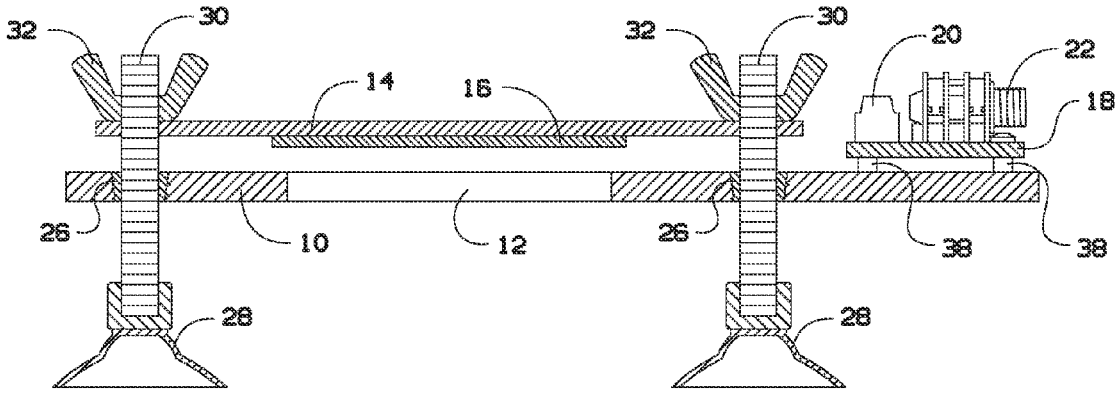
FIG. 5 is a section view of an embodiment of the invention, taken along line 5-5 in FIG. 3

Turning to FIG. 3, FIG. 4 and FIG. 5, base plate 10 comprises central section 12 which is configured to accommodate inverted pickup 52 as shown in FIG. 2. Pickup mounting plate 14 is mechanically coupled to foam rubber strip 16 which is placed immediately adjacent to inverted pickup 52. On one end of base plate 10 are four stand-offs 38 configured to accommodate circuit board 18. Pickup mounting plate 14 and base plate 10 can be made from acrylic which is a flexible material that can easily be bent to accommodate a wide range of inverted pickups 52.

Circuit board 18 is electrically coupled to terminal block 20, phone jack 22 and slide switch 24. Terminal block 20 is configured to receive pickup wires 54 from inverted pickup 52. Phone jack 22 is configured to accommodate a cord to connect phone jack 22 to an amplifier which can be used to test inverted pickup 52.

Circuit board 18 further comprises four fastener accommodations 42 which can be used to accommodate fasteners 40. Fasteners 40 can then be attached to stand offs 38 which elevates circuit board 18 from base plate 10 in order to dissipate heat from circuit board 18.

Base plate 10 is further configured with two base plate holes 50. Each base plate hole is configure to accommodate a threaded insert 26. Each threaded insert 26 can accommodate a leveling rod 30 wherein each leveling rod is attached to a suction cup 28.

Pickup mounting plate 14 further comprises a first pickup mounting plate hole 48 and a second pickup mounting plate hole 48. First pickup mounting plate hole 48 is configured to accommodate first leveling rod 30, which is attached to first suction cup 28. Likewise, second pickup mounting plate hole 48 is configured to accommodate second leveling rod 30, which is attached to second suction cup 28.

Therefore, a user can insert first leveling rod 30 through first threaded insert 26 in first base plate hole 50, through first pickup mounting plate hole 48 where pickup mounting plate 14 is clamped down with first wing nut 32. Simultaneously, a user can insert second leveling rod 30 through second threaded insert 26 in second base plate hole 50, through second pickup mounting plate hole 48 where pickup mounting plate 14 is clamped down with second wing nut 32.

To use the system it is noteworthy that inverted pickup 52 is rendered upside down through central section 12 and thus will have to be rotated 180 degrees in order for the base side of inverted pickup 52 to be proximate the base string on guitar 56. Next, there are four terminals on terminal block 20, each of these can accommodate the same combination of wires as indicated in the instruction manual for inverted pickup 52. For instance, in many models the ground and another wire will be inserted into the first terminal and then tightened down with the first terminal screw.

After this a cable can electrically couple phone jack 22 to an amplifier. The user can adjust the output to the amplifier with slide switch 24. For instance, the pickup can be wired in single coil configuration, parallel configuration or series configuration. This permits the user to use the system for testing inverted pickup 52 without having to solder inverted pickup 52 to anything.

Pickup wire 52 can be held in place with wire clip 34. Wire clip 24 is mechanically coupled to base plate 10 by inserting wire clip fastener 44 through wire clip fastener hole 46.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A system configured to test a pickup on a guitar having guitar strings; the system comprising:

an inverted pickup mechanically coupled to pickup wires;

a testing system connected to the inverted pickup, wherein the testing system further comprises:

a base plate having a central section configured to accommodate the inverted pickup; wherein the inverted pickup is proximate the guitar strings;

a first leveling rod configured to be threaded through the base plate and inserted through a pickup mounting plate; wherein the first leveling rod is further configured to be immediately adjacent to the guitar;

a second leveling rod configured to be threaded through the base plate and inserted through the pickup mounting plate; wherein the second leveling rod is further configured to be immediately adjacent to the guitar;

wherein the pickup mounting plate is immediately adjacent to the inverted pickup;

a circuit board mechanically coupled to the base plate and configured to be electrically coupled to the pickup wires; wherein the circuit board further comprises a phone jack which is configured to be electrically coupled to an amplifier;

wherein the amplifier emits sound which can be used to test the inverted pickup.

2. The system of claim 1, wherein the circuit board further comprises a terminal block configured to receive the pickup wires.

3. The system of claim 2, wherein the circuit board further comprises a slide switch configured to modify the wiring connection coming from the inverted pickup and ultimately vary the sound to the amplifier.

4. The system of claim 3, wherein the circuit board further is mechanically coupled to the base plate with stand-offs which slightly raise the circuit board from the base plate to facilitate cooling the base plate.

5. The system of claim 1, wherein the first leveling rod is further configured to be immediately adjacent to the guitar with a first suction cup; and wherein the second leveling rod is further configured to be immediately adjacent to the guitar with a second suction cup.

6. The system of claim 1, further comprising a foam rubber strip mechanically coupled to the pickup mounting plate; wherein the foam rubber strip further secures the inverted pickup to the base plate.

* * * * *